US011419394B2

(12) United States Patent
Chen

(10) Patent No.: US 11,419,394 B2
(45) Date of Patent: Aug. 23, 2022

(54) STRUCTURE OF WATCHCASE AND WATCH STRAP CONNECTED BASED ON MAGNETIC ATTRACTION FORCE

(71) Applicant: Y.F. COMPANY LITMITED, Dongguan (CN)

(72) Inventor: Yanning Chen, Dongguan (CN)

(73) Assignee: Y.F. COMPANY LITMITED, Dongguan (CN)

( * ) Notice: Subject to any disclaimer, the term of this patent is extended or adjusted under 35 U.S.C. 154(b) by 526 days.

(21) Appl. No.: 16/541,192

(22) Filed: Aug. 15, 2019

(65) Prior Publication Data

US 2020/0146404 A1 May 14, 2020

(30) Foreign Application Priority Data

Nov. 9, 2018 (CN) ..... 201811331929.7

(51) Int. Cl.
*A44C 5/14* (2006.01)

(52) U.S. Cl.
CPC ..... *A44C 5/14* (2013.01)

(58) Field of Classification Search
CPC ..... A44C 5/147; A44C 5/14; A44D 2203/00; A44B 11/266; A44B 11/25; A45C 13/1069; G04B 37/1446; G04B 37/1486; G04B 37/1413
See application file for complete search history.

(56) References Cited

U.S. PATENT DOCUMENTS

| | | | | |
|---|---|---|---|---|
| 4,622,726 | A * | 11/1986 | Nakamura | A44C 5/2057 24/663 |
| 5,701,640 | A * | 12/1997 | Locher | A44C 5/2071 24/303 |
| 9,826,789 | B2 * | 11/2017 | Dey | A44C 27/00 |
| 10,058,148 | B1 * | 8/2018 | Wittenberg | A44C 5/147 |
| 10,061,350 | B2 * | 8/2018 | Magi | A41D 13/08 |
| 2017/0265607 | A1 * | 9/2017 | Hatanaka | G04B 37/1486 |
| 2020/0064778 | A1 * | 2/2020 | Guillot | G04B 37/1446 |

* cited by examiner

*Primary Examiner* — Edwin A. Leon
(74) *Attorney, Agent, or Firm* — Hemisphere Law, PLLC; Zhigang Ma

(57) ABSTRACT

The application relates to a structure of a watch strap and a watchcase connected based on a magnetic attraction force. Two ends of the watchcase each are provided with a connection head, and two ends of the watch strap each are provided with a magnetic latching structure cooperated with the connection head. The magnetic latching structure includes a connecting head receiving recess and a first magnet. An opening matched with an engagement bolt is defined in the watch strap, the opening and the first magnet are positioned at two opposite sides of the connecting head receiving recess, the engagement bolt is positioned in the opening, a hollow groove is defined in the connection head and matched with the engagement bolt, and a second magnet is disposed at a top portion of the engagement bolt.

8 Claims, 9 Drawing Sheets

STRUCTURE OF WATCHCASE AND WATCH STRAP CONNECTED BASED ON MAGNETIC ATTRACTION FORCE

FIELD OF THE DISCLOSURE

The disclosure relates to the field of wrist watch technologies, and more particularly to a structure of a watchcase and a watch strap connected based on a magnetic attraction force.

BACKGROUND

A conventional watch strap is difficult to be disassembled and replaced, and there are disadvantages in that other accessories would be scratched when it is disassembled or replaced. Because the conventional watch strap has a spring needle structure, and needs other disassembly tools to squeeze the spring needle structure thereby to take out the watch strap. It is very inconvenient to replace the watch strap in such a way.

SUMMARY

The disclosure provides a structure of a watchcase and a watch strap connected based on a magnetic attraction force, which is easy and convenient to replace the watch strap. The structure uses a magnet force and a latching structure to fix the watch strap and the watch strap is easy to be replaced. It fundamentally overcomes the shortcomings of the conventional watch strap that hard to replace and easy to scratch other accessories when replacing. The structure facilitates to disassemble and replace the watch strap. It is not only suitable for rubber straps, but also suitable for metal connecting straps and metal mesh straps, with advantages of simple, practical, and easy to disassemble and replace.

To achieve the above object, technical solutions of the disclosure are provided as follows.

A first embodiment provides a structure of a watch strap and a watchcase connected based on a magnetic attraction force. Two ends of the watchcase each are provided with a connection head for connecting with the watch strap, and two ends of the watch strap each are provided with a magnetic latching structure cooperated with the connection head. The magnetic latching structure comprises a connection head receiving recess and a first magnet, the connection head receiving recess is defined in the watch strap, and the first magnet is attached onto an inner surface of the watch strap, an opening matched with an engagement bolt is defined in the watch strap, the opening and the first magnet are positioned at two opposite sides of the connection head receiving recess, the engagement bolt is positioned in the opening, a hollow groove is defined in the connection head and matched with the engagement bolt, and a second magnet is disposed at a top portion of the engagement bolt.

In one embodiment, the top portion of the engagement bolt is provided with 1-5 second magnet fixing hole(s), and the second magnet is fixed in the second magnet fixing hole(s).

In one embodiment, a buckle convex is provided at a middle portion of the engagement bolt, and a blocking portion matched with the buckle convex is provided in the watch strap to prevent the engagement bolt from falling off.

In one embodiment, a base is provided at a bottom portion of the engagement bolt.

A second embodiment of the disclosure provides a structure of a watch strap and a watchcase connected based on a magnetic attraction force. Two ends of the watch strap each are provided with a connection head for connecting with the watchcase, and two ends of the watchcase each are provided with a magnetic latching structure cooperating with the connection head. The magnetic latching structure comprises a connection head receiving recess and a first magnet, the connection head receiving recess is defined in the watchcase, and the first magnet is attached onto an inner surface of the connection head receiving recess of the watchcase, an opening matched with the an engagement bolt is defined in the watchcase, the opening and the first magnet are positioned at two opposite sides of the connection head receiving recess, the engagement bolt is positioned in the opening, a hollow groove is defined in the connection head and matched with the engagement bolt, and a second magnet is disposed at a top portion of the engagement bolt.

In one embodiment, the top portion of the engagement bolt is provided with 1-5 second magnet fixing hole(s), and the second magnet is fixed in the second magnet fixing hole(s).

In one embodiment, a buckle convex is provided at a middle portion of the engagement bolt, and a blocking portion matched with the buckle convex is provided in the watch strap to prevent the engagement bolt from falling off.

In one embodiment, a base is provided at a bottom portion of the engagement bolt.

The disclosure has the beneficial effects as follows.

1. The magnetic structure makes it is easy and convenient to disassemble or replace the watch strap, and other accessories would not be scratched.

2. The disclosure is not only suitable for rubber straps, but also suitable for metal connecting straps and metal mesh straps, with advantages of simple, practical, and easy to disassemble and replace 3. The disclosure uses a magnetic force to fix the watch strap, when the base of the fastener is pulled up to be released from the magnetic force, the watch strap can be pulled out.

DESCRIPTIONS OF REFERENCE NUMERALS

Figure 1:
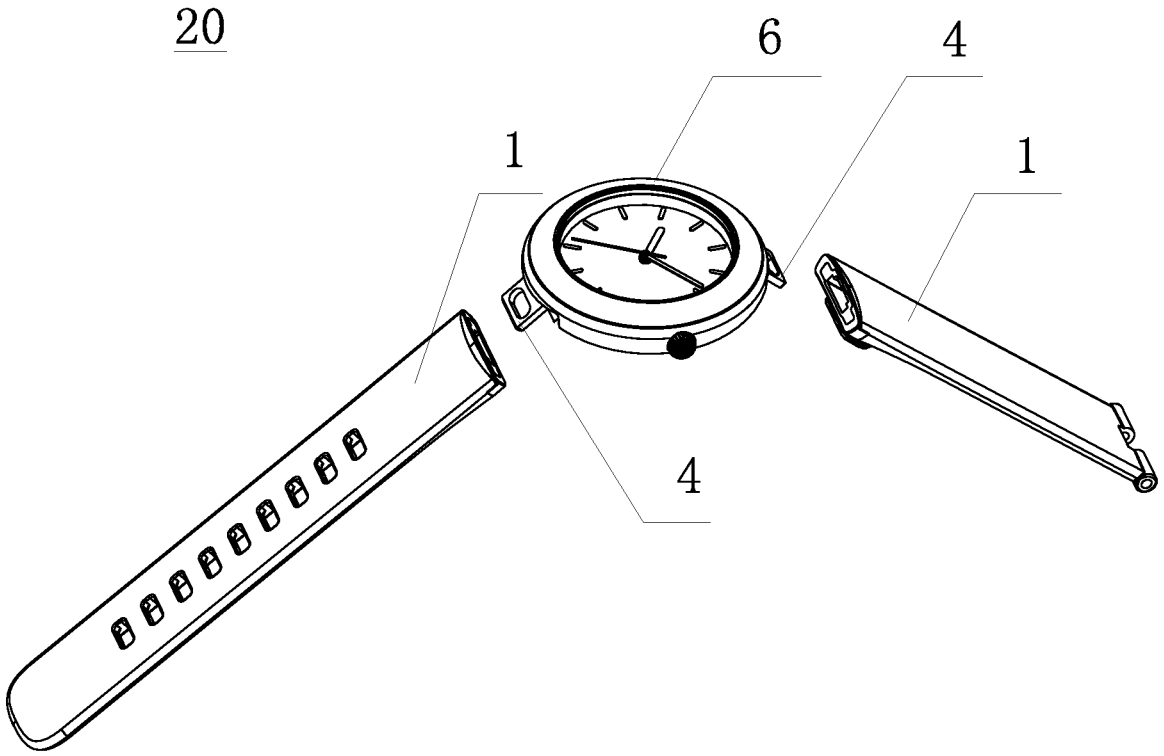
FIG. 1 is a schematic structural view of a first embodiment of the disclosure.
Figure 2:
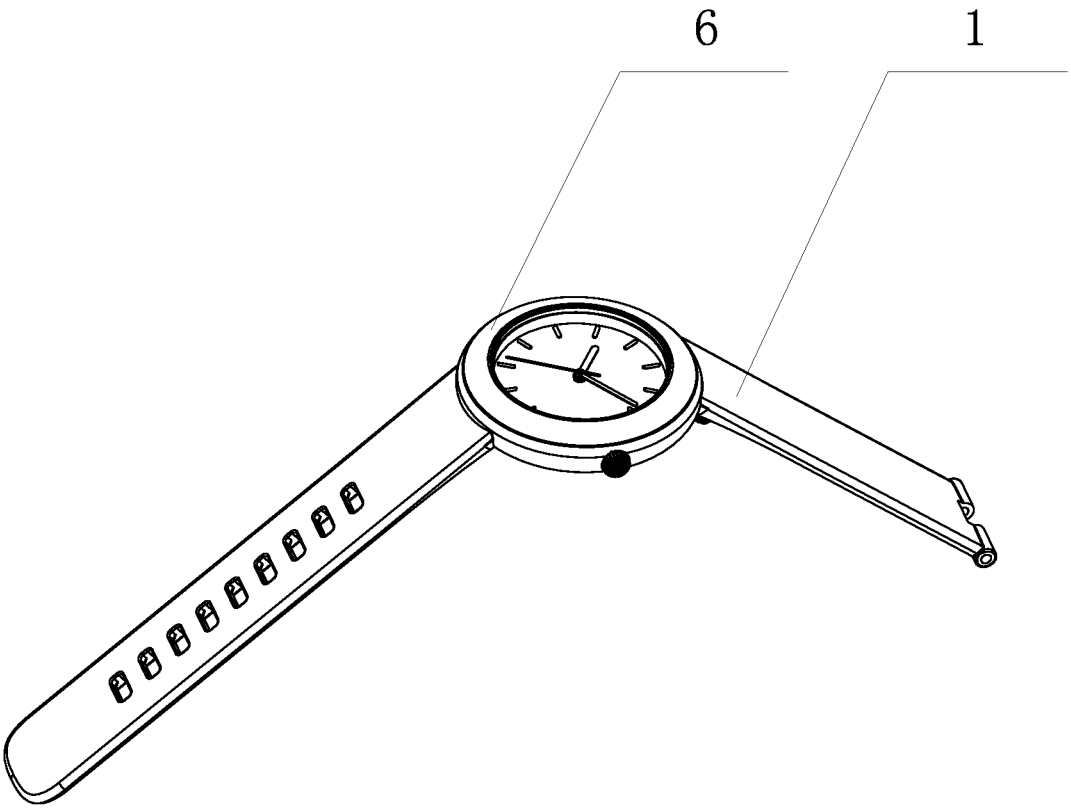
FIG. 2 is a schematic structural view of FIG. 1 in an assembled state.
Figure 3:
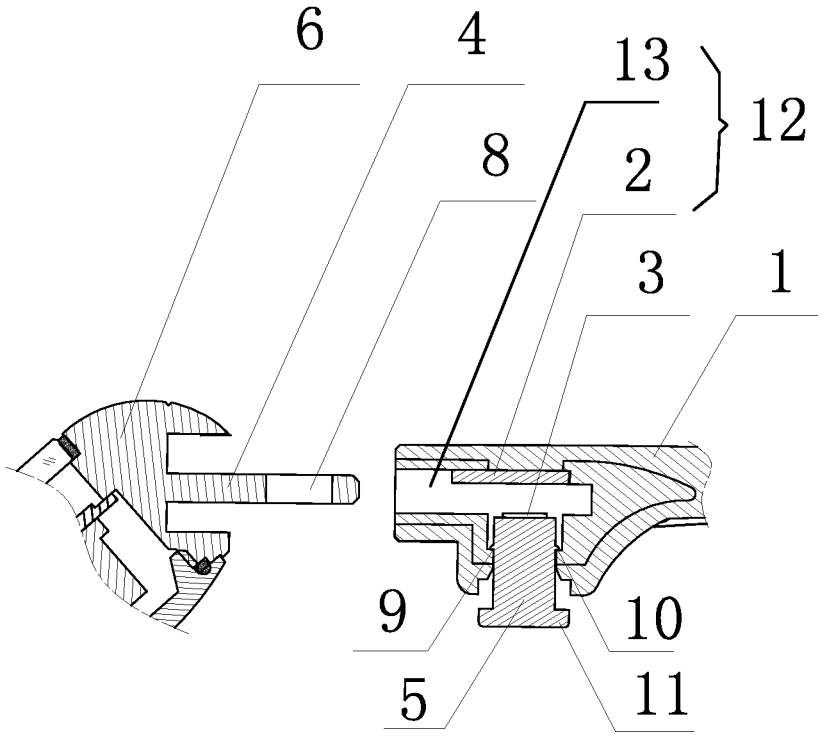
FIG. 3 is a schematic structural view of a connection head and a magnetic latching structure of the first embodiment of the disclosure.
Figure 4:
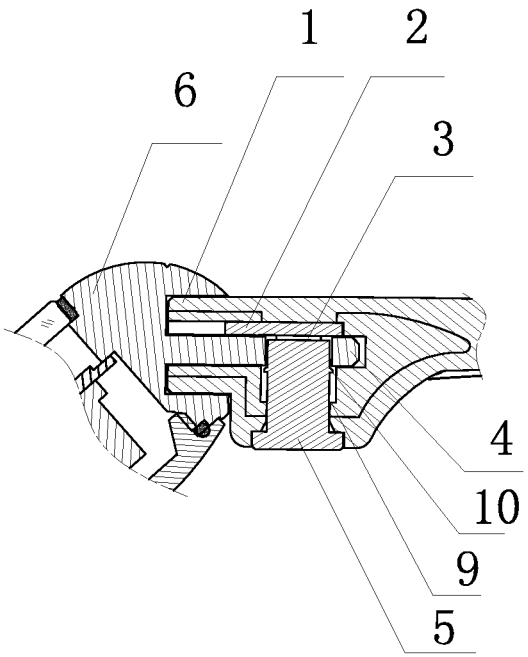
FIG. 4 is a schematic structural view of FIG. 3 in an assembled state.
Figure 5:
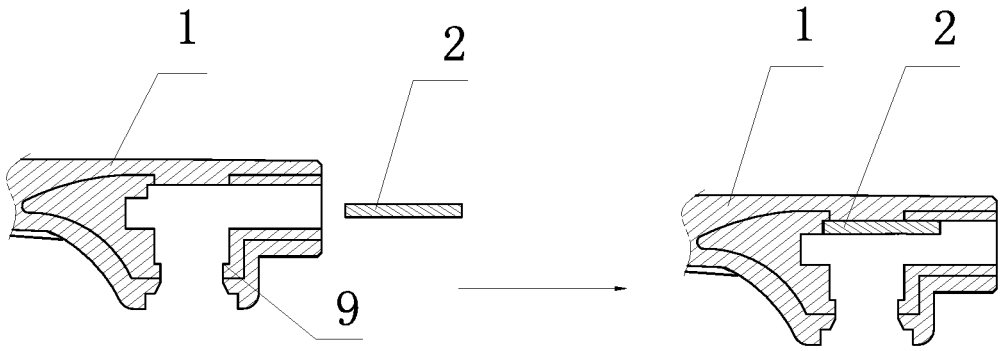
FIG. 5 is a schematic view showing a first step of assembling the magnetic latching structure.
Figure 6:
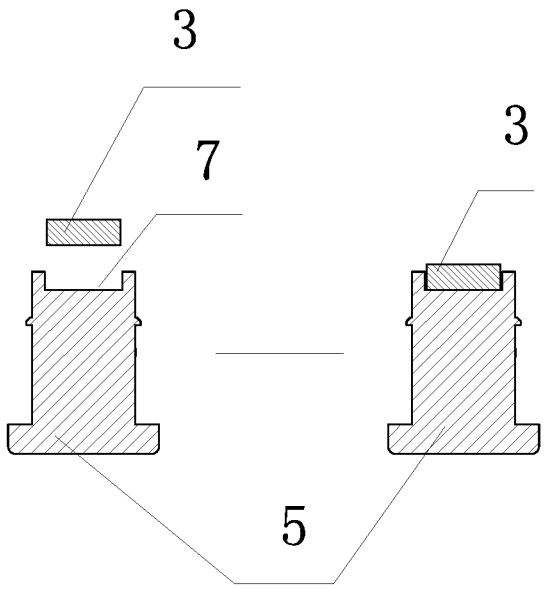
FIG. 6 is a schematic view showing the assembly of an engagement bolt.
Figure 7:
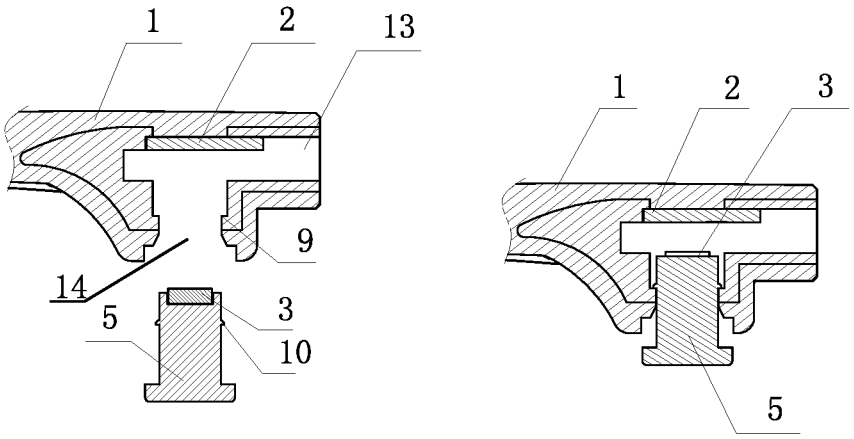
FIG. 7 is a schematic view showing the assembly of the magnetic latching structure.

1—watch strap; 2—first magnet; 3—second magnet; 4—connection head; 5—engagement bolt; 6—watchcase; 7—second magnet fixing hole; 8—hollow groove;

9—blocking portion; 10—buckle convex; 11—base; 12—magnetic latching structure; 13—connection head receiving recess; 14—opening; 20, 30—structure of a watch strap and a watchcase connected based on a magnetic attraction force

DETAILED DESCRIPTION OF PREFERRED EMBODIMENTS

The technical solutions in the embodiments of the disclosure are clearly and completely described in the following with reference to the accompanying drawings in the embodiments of the disclosure. It is obvious that the described embodiments just are a part of the embodiments, not all embodiments of the disclosure. All other embodiments could be obtained by those skilled in the art based on the embodiments of the present disclosure without creative efforts are within the scope of the present disclosure.

As shown in FIGS. 1-7, a first embodiment of the disclosure provides a structure of a watch strap and a watchcase connected based on a magnetic attraction force 20, which includes a watch strap 1 and a watchcase 6. One of ordinary skill in the art understands that the watch strap 1 may include two sections that capable of being snap-fitted together or separated, the watch strap 1 may also just include one section capable of being folded or unfolded. Two ends of the watchcase 6 each are provided with a connection head 4 for connecting with the watch strap 1, and two ends of the watch strap 1 each are provided with a magnetic latching structure 12 cooperated with the connection head 4. The magnetic latching structure 12 includes a connection head receiving recess 13, a first magnet 2 and an engagement bolt 5. The connection head receiving recess 13 and the first magnet 2 are disposed in the watch strap 1, the first magnet 2 is attached onto an inner surface of the connection head receiving recess 13 of the watch strap 1. An opening 14 matched with the engagement bolt 5 is defined in the watch strap 1, and the first magnet 2 and the opening 14 are positioned at two opposite sides of the connection head receiving recess 13. The engagement bolt 5 is disposed in the opening 14. A hollow groove 8 is defined in the connection head 4 and is matched with the engagement bolt 5, and a second magnet 3 is provided at a top portion of the engagement bolt 5 and is opposite to the first magnet 2.

The top portion of the engagement bolt 5 is provided with two second magnet fixing holes 7, and the second magnet 3 is fixed in the second magnet fixing holes 7.

A buckle convex 10 is provided at an outer surface of a middle portion of the engagement bolt 5, and a blocking portion 9 matched with the buckle convex 10 is provided in the watch strap 1 to prevent the engagement bolt 5 from falling off.

A base 11 is provided at a bottom portion of the engagement bolt 5.

Figure 8:
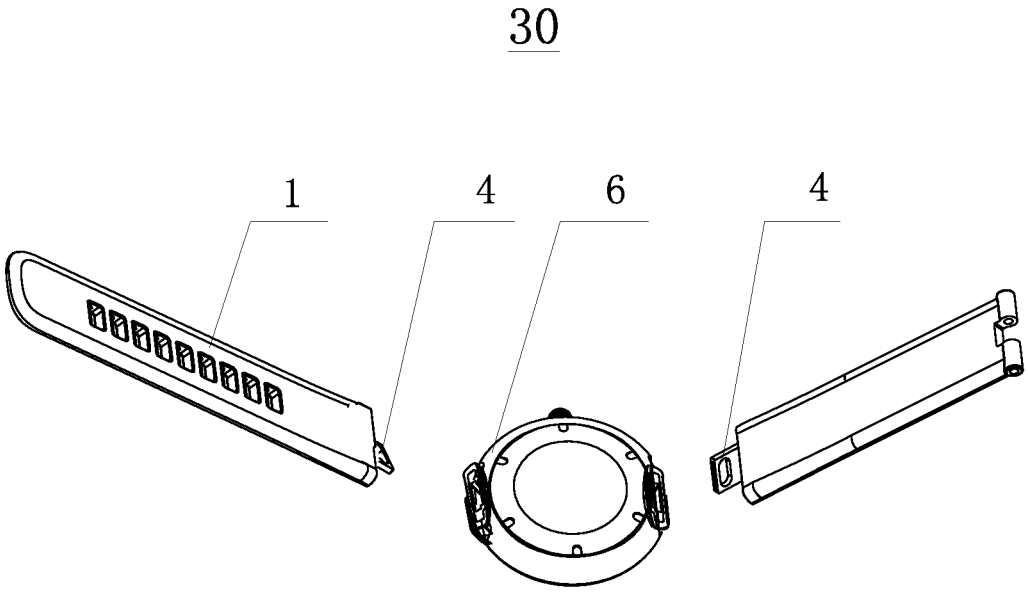
FIG. 8 is a schematic structural view of a second embodiment of the disclosure.
Figure 9:
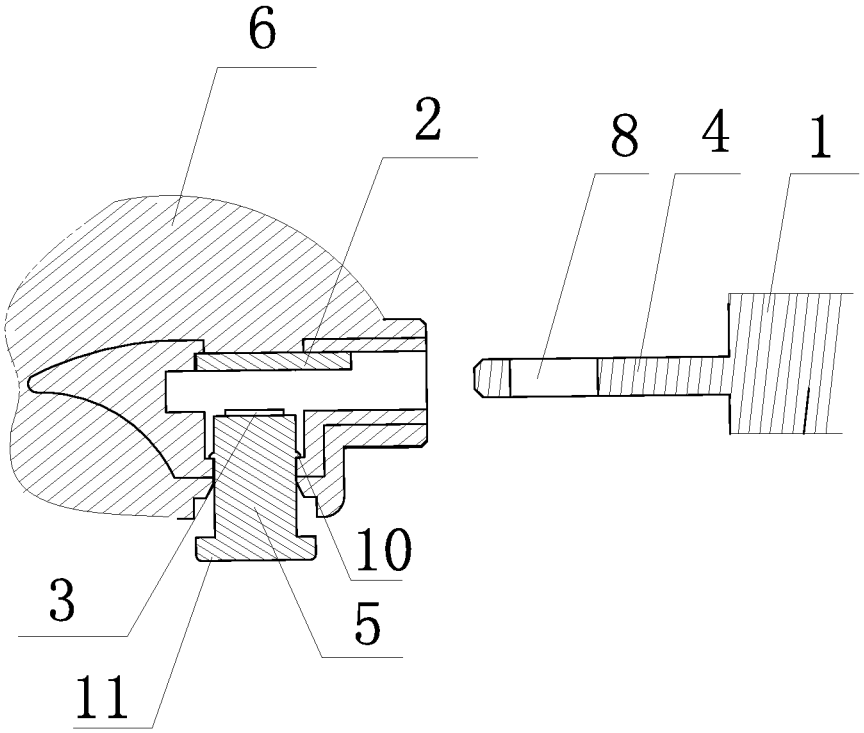
FIG. 9 is a schematic structural view of a connection head and a magnetic latching structure of the second embodiment of the disclosure.

Referring to FIG. 8 and FIG. 9, a second embodiment of the disclosure provides a structure of a watch strap and a watchcase connected based on a magnetic attraction force 30, which includes a watch strap 1 and a watchcase 6. Two ends of the watch strap 1 each are provided with a connection head 4 for connecting with the watchcase 6, and two ends of the watchcase 6 each are provided with a magnetic latching structure 12 cooperated with the connection head 4. The magnetic latching structure 12 includes a connection head receiving recess 13, a first magnet 2 and a engagement bolt 5. The connection head receiving recess 13 and the first magnet 2 are disposed in the watchcase 6, the first magnet 2 is attached on an inner surface of the watchcase 6. The watchcase 6 also is provided with an opening 14 matched with the engagement bolt 5, the opening 14 and the first magnet 2 are positioned at two opposite sides of the connection head receiving recess 13. The engagement bolt 5 is disposed in the opening 14. A hollow groove 8 is defined in the connection head 4 and is matched with the engagement bolt 5, and a second magnet 3 is provided at a top portion of the engagement bolt 5 and is opposite to the first magnet 2.

The top portion of the engagement bolt 5 is provided with one second magnet fixing hole 7, and the second magnet 3 is fixed in the second magnet fixing hole 7.

A buckle convex 10 is provided at an outer surface of a middle portion of the engagement bolt 7, and a blocking portion 9 matched with the buckle convex 10 is disposed in the watch strap 1 to prevent the engagement bolt 5 from falling off.

A base 11 is provided at a bottom portion of the engagement bolt 5.

An assembly principle of the present disclosure is described as follows. If the magnetic latching structure is disposed in the watch strap, the first magnet is attached and fixed in the watch strap, and the second magnet is fixed in the second magnet fixing hole of the top portion of the engagement bolt. When the engagement bolt is inserted into the opening of the watch strap, and the connection head of the watchcase is inserted into the connection head receiving recess of the watch strap, then the watch strap is assembled onto the watchcase. If the watch strap is needed to be replaced, the engagement bolt can be pulled out from the opening to release the watch strap and then the watch strap can be replaced.

If the magnetic latching structure is disposed in the watchcase, the first magnet is attached and fixed in the watchcase, and the second magnet is fixed in the second magnet fixing hole of the top portion of the engagement bolt. When the engagement bolt is inserted into the opening of the watchcase, and the connection head of the watch strap is inserted into the connection head receiving recess of the watchcase, then the watch strap is assembled onto the watchcase. If the watch strap is needed to be replaced, the engagement bolt can be pulled out from the opening to release the watch strap and then the watch strap can be replaced.

In summary, the technical solution of the disclosure can replace the watch strap very conveniently without other accessory tools, and would not cause any damage to the watchcase or the watch strap. The structure is simple and practical.

Skilled person in the art may make some modifications and substitutions under the teaching of the technical solution of the disclosure. These modifications or substitutions, which are based on the essences of the technical solution of disclosure, are still within the scope of the technical solutions of the embodiments of the disclosure.

What is claimed is:

1. A combination of a watch strap and a watchcase connected based on a magnetic attraction force, comprising:

the watch strap and the watchcase, wherein two ends of the watchcase each are provided with a connection head for connecting with the watch strap, and two ends of the watch strap each are provided with a magnetic latching structure cooperated with the connection head, wherein the magnetic latching structure comprises a connection head receiving recess and a first magnet, the connection head receiving recess is defined in the watch strap, the first magnet is attached onto an inner surface of the watch strap, an opening matched with an engagement bolt is defined in the watch strap, the opening and the first magnet are positioned at two opposite sides of the connection head receiving recess, the engagement bolt is positioned in the opening, a hollow groove is defined in the connection head and matched with the engagement bolt, and a second magnet is disposed at a top portion of the engagement bolt.

2. The combination according to claim 1, wherein the top portion of the engagement bolt is provided with 1-5 second magnet fixing hole(s), and the second magnet is fixed in the second magnet fixing hole(s).

3. The combination according to claim 1, wherein a buckle convex is provided at a middle portion of the engagement bolt, and a blocking portion matched with the buckle convex is provided in the watch strap to prevent the engagement bolt from falling off.

4. The combination according to claim 1, wherein a base is provided at a bottom portion of the engagement bolt.

5. A combination of a watch strap and a watchcase connected based on a magnetic attraction force, comprising:

the watch strap and the watchcase, wherein two ends of the watch strap each are provided with a connection head for connecting with the watchcase, and two ends of the watchcase each are provided with a magnetic latching structure cooperating with the connection head, wherein the magnetic latching structure comprises a connection head receiving recess and a first magnet, the connection head receiving recess is defined in the watchcase, the first magnet is attached onto an inner surface of the connection head receiving recess of the watchcase, an opening matched with the an engagement bolt is defined in the watchcase, the opening and the first magnet are positioned at two opposite sides of the connection head receiving recess, the engagement bolt is positioned in the opening, a hollow groove is defined in the connection head and matched with the engagement bolt, and a second magnet is disposed at a top portion of the engagement bolt.

6. The combination according to claim 5, wherein the top portion of the engagement bolt is provided with 1-5 second magnet fixing hole(s), and the second magnet is fixed in the second magnet fixing hole(s).

7. The combination according to claim 5, wherein a buckle convex is provided at a middle portion of the engagement bolt, and a blocking portion matched with the buckle convex is provided in the watch strap to prevent the engagement bolt from falling off.

8. The combination according to claim 5, wherein a base is provided at a bottom portion of the engagement bolt.

* * * * *